US005505110A

United States Patent [19]

Richardson et al.

[11] Patent Number: 5,505,110

[45] Date of Patent: Apr. 9, 1996

[54] PEG WITH INCLINED BORE FOR STRINGED MUSICAL INSTRUMENTS

[76] Inventors: Patrick J. Richardson, 1623 NW. 8th Ave.; Henry C. Bohn, 103 NE. 14th Ave., both of Camas, Wash. 98607

[21] Appl. No.: 501,733

[22] Filed: Jul. 12, 1995

[51] Int. Cl.[6] ..... G10D 3/14

[52] U.S. Cl. ..... 84/304

[58] Field of Search ..... 84/304

[56] References Cited

U.S. PATENT DOCUMENTS

| | | | |
|---|---|---|---|
| 405,816 | 6/1889 | White | 84/304 |
| 473,347 | 4/1892 | Rowe | 84/304 |
| 534,063 | 2/1895 | Hafer et al. | 84/304 |
| 2,029,134 | 6/1934 | Stanley et al. | 84/304 |
| 4,398,443 | 8/1983 | Kovach | 84/304 |

FOREIGN PATENT DOCUMENTS

| | | |
|---|---|---|
| 411001 | 7/1914 | France . |
| 56935 | 11/1890 | Germany . |
| 172991 | 11/1905 | Germany . |
| 185015 | 6/1906 | Germany . |
| 3029218 | 3/1982 | Germany . |
| 22701 | 7/1909 | United Kingdom . |

*Primary Examiner*—Patrick J. Stanzione
*Attorney, Agent, or Firm*—Dowell & Dowell

[57] ABSTRACT

A peg for stringed musical instruments which allows quick and easy string replacement and which includes an inclined bore which communicates with a groove that encircles the head of the peg. In a preferred embodiment, a notch is provided in the head of the peg and extends transversely from the groove and in alignment with a bore opening spaced from the center of the groove.

9 Claims, 2 Drawing Sheets

PEG WITH INCLINED BORE FOR STRINGED MUSICAL INSTRUMENTS

BACKGROUND OF THE INVENTION

1. Field of the Invention

This invention relates to string attachment means and, in particular, to an improved peg for use on stringed musical instruments.

2. Description of Prior Art

Originally, stringed musical instruments used strings made of gut or other animal or vegetable fiber. Fairly low tensions were needed to reach a desired pitch.

Today the majority of stringed instruments use strings made of metal. These strings may be with or without wrapping and are available in a wide range of diameters. This gives them a broad range of tonal quality. Metal strings require a fairly high tension, due to their weight, to achieve a desired pitch.

The higher tension used on metal strings creates a problem in that a very slight amount of slippage causes them to be seriously out of tune. A secure hold of the string on the tuning peg is thus required.

In U.S. Pat. No. 405,816 to White (1889), German patent 172,991 to Romer (1906), and French patent 411,087 to Renon (1914), the combination of wood pegs and gut or similar strings used will sufficiently bind the string and prevent slippage at a little more than half a revolution of the pegs. However, due to the higher tensions required when using metal strings, a half wrap is not sufficient to prevent slippage with such structures. This is because the force created at the half revolution point is directed toward the center of such pegs, instead of through the string that protrudes out of the bores in the pegs. Furthermore, the pegs disclosed in U.S. Pat. No. 405,816 and German patent 172,991 are even more inefficient with smaller diameter strings. The wrap portion of a string will rest more in the channel associated with such pegs than against the string that protrudes out of the bores therein. Lastly, the peg disclosed in U.S. Pat. No. 405,816 requires multiple wraps of string to fully utilize the mechanics of the design. This significantly increases the time needed to change a string.

Other earlier pegs, such as disclosed in U.S. Pat. No. 473,347 to Rowe (1892), German patent 185,015 to Masson (1907) and British patent 22,701 to Sweet (1908), address the slippage problem in a different way. A knot is tied after the string is inserted through a bore or notch in the pegs. The knot then locks against the peg when tension is applied. These designs utilize the pliability of gut or other similar strings. However, a severe bend created by a knot would greatly weaken a metal string. This makes it more susceptible to breakage when tension is applied.

German patent 56,935 to Balthasar, et al. (1891) and U.S. Pat. No. 2,029,134 to Stanley (1934) disclose pegs which are designed to use metal strings. In these designs, sufficient locking is accomplished by using multiple wraps of string. Though this provides a firm attachment, it adds considerable time and effort to the string changing process. The structure disclosed in U.S. Pat. No. 2,029,134 also requires a person to pre-cut the string to length before attachment. Metal strings normally have at least six inches of extra length.

More recently, German patent 3,029,218 to Hoin (1982) requires a string to be threaded through two bores in a peg. The extra hole doubles the manipulation required to change a string. There is also limited access to the bores due to the mounting design. This tight space increases the difficulty of the string changing process. Furthermore, as shown in FIG. 2, as the string travels through the peg, it makes a ninety degree turn. The ends of steel strings are very sharp and will catch at the bend, making the string threading more difficult.

SUMMARY OF THE INVENTION

The present invention is directed to tuning pegs for use with stringed musical instruments. Each tuning peg includes a circular groove which is spaced from the outer head portion thereof. An inclined bore is provided through the peg beginning with an entry opening within the groove and extending to an exit opening spaced from the center of the groove. Preferably, the exit opening is immediately adjacent the groove but, in some instances, may be spaced therefrom and on an opposite side relative to the head portion. A notch extends generally transversely from the groove toward the head portion and in general alignment with the exit opening.

In use, an end of a string is inserted through the bore of a peg from the entry opening and outwardly of the exit opening. Thereafter, the end of the string is pulled along the groove and the peg rotated about its elongated axis with the string being seated within the groove thereby, binding the end portion of the string adjacent the exit opening upon a one-half rotation of the peg.

In the preferred embodiment, the bore extends through the longitudinal axis of the peg. Accordingly, several objects and advantages of the present peg with inclined bore are:

a) to provide superior binding of the string using half a wrap;

b) to accomodate multiple string diameters;

c) to provide a quick and simple method to replace strings;

d) to provide a string attachment means that does not weaken the string;

e) to eliminate the need to pre-cut a string before attaching;

f) to reduce the length of the string needed for attachment;

g) to provide easy access to the threading bore; and h) to allow a simple manufacturing processes to be used in making the peg.

Further objects and advantages will become apparent from a consideration of the ensuing description and drawings.

DESCRIPTION OF THE PREFERRED EMBODIMENT

Figure 1:
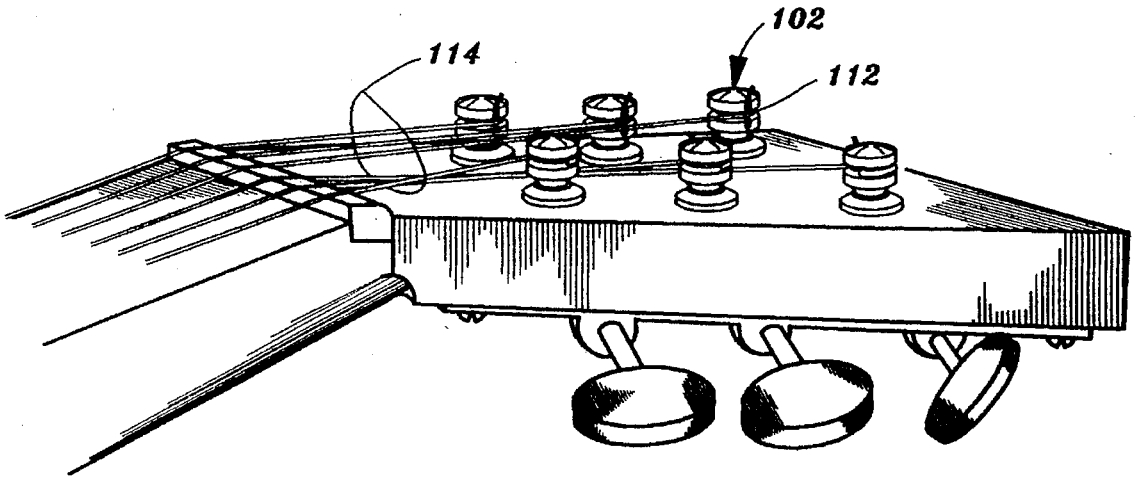
FIG. 1 is a perspective view of a typical application of the peg with inclined bore of the present invention.
Figure 2:
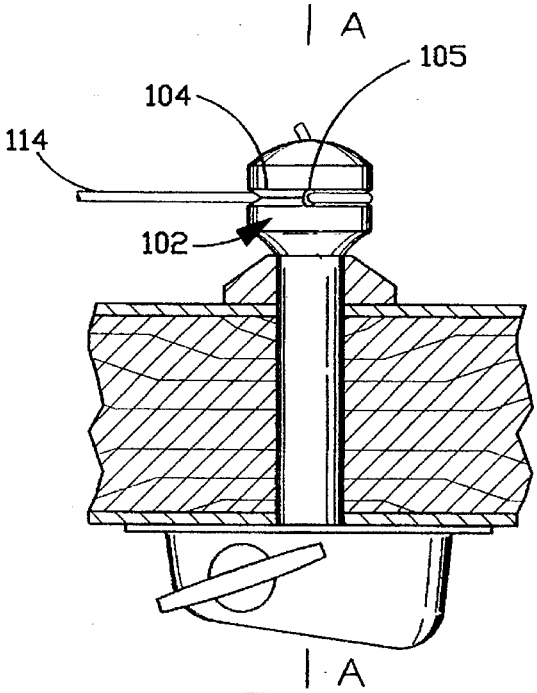
FIG. 2 is a front elevated view of the peg of FIG. 1.

FIG. 1 shows a perspective view of the pegs 102 of the present invention on the head of a guitar. A string 114 wraps half a revolution around one of the pegs 102 and creates a binding point 112. As shown in FIG. 2, each peg 102 includes an inclined bore 108. A "V" groove 104, which is perpendicular to the vertical axis "A—A" of the peg, encircles the peg. Inclined bore 108 enters the center of the "V" groove 104 and goes through the vertical peg axis and opens at an exit opening 109 below the center of the "V" groove and preferably below and proximate to the groove. String 114 lies in "V" groove 104.

Figure 3:
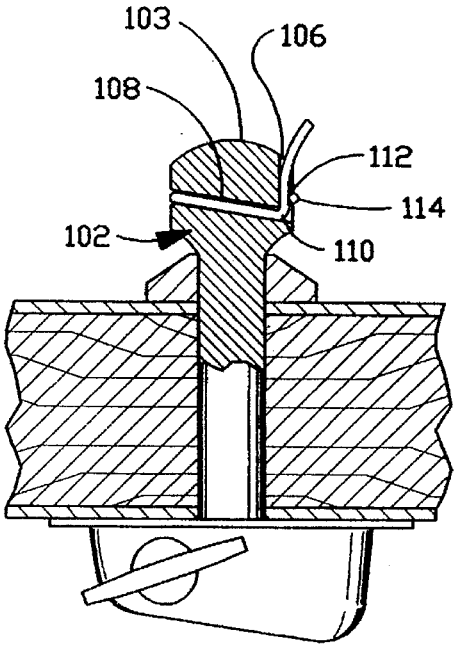
FIG. 3 is a cross sectional side elevational view of the peg of FIG. 1.
Figure 4:
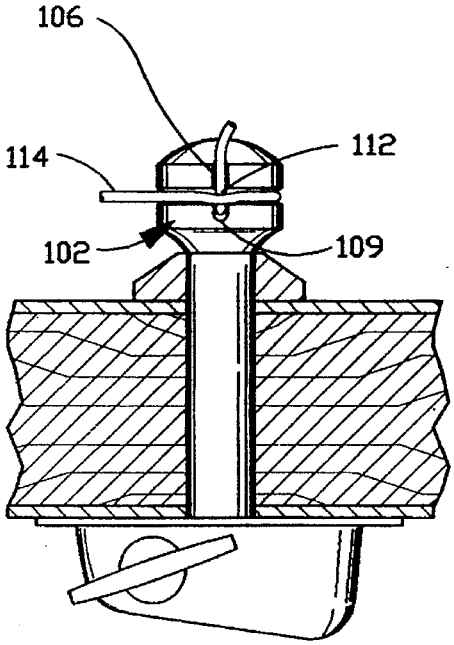
FIG. 4 is a rear elevational view of the peg of FIG. 1.

FIG. 3 is a cross sectional side elevational view of peg 102 and FIG. 4 is a rear elevational view thereof. String 114 passes through inclined bore 108 and lies in a "V" notch 106 creating a bend 110. The notch 106 extends transversely with respect to the groove 104 and in general alignment with the exit opening 109 of the bore and communicates with the groove, as shown in FIG. 3. It is preferred that the notch extends to the head portion 103 of the peg, as shown in FIGS. 3 and 4, and that the exit opening of bore 108 be spaced immediately below the groove 104 spaced from the head portion of the peg. In some instances, the exit opening 109 of bore 108 may be spaced from the groove 104 so that the notch 106 extends below the groove. As the peg is rotated about its axis, string 114 overlaps itself creating binding point 112. The depth of the "V" groove 104 and the "V" notch 106 are preferably equal.

The operation of the peg is as follows. The string 114 is inserted through the entry opening 105 of inclined bore 108 which is located in the center of "V" groove 104. String 114 passes through inclined bore 108 and exits underneath the center of "V" groove 104. The end of string 114 is pulled hand tight and is bent upwards into the "V" notch 106 creating bend 110. A half revolution is now applied to peg 102 by any conventional mechanism thereby creating binding point 112 of the string on itself. String 114 is now securely attached to peg 102. Further tension is then applied to achieve the desired tone.

Accordingly, the present peg design offers a superior string attachment means. It also provides a quick and simple method for changing metal strings. There is no need to adjust or pre-cut the string length before attaching. The string is simply inserted through the bore, pulled hand tight, bent upwards and the peg rotated half a revolution. The string can be removed just as easily as it was attached. Furthermore, the design is simple to make and reduces the amount of string needed to securely attach the string to the peg. Lastly, the pegs of the present invention accomodate all string diameters, provide easy access to the threading bores and will not weaken strings.

Although the description above is for one design specification, it should not be construed as limiting the scope of the invention but as merely providing an illustration of the preferred embodiment of the invention. For example, the inclined bore can be drilled offset from the peg axis to set up the binding point at less than one half revolution. Also the groove and notch can be many different shapes such as round, oval, square, etc.

Thus the scope of the invention should be determined by the appended claims and their legal equivalents rather than by the examples given.

We claim:

1. A peg for adjustably securing a string to a stringed musical instrument, comprising:

a) a peg having an axis and a head portion;

b) a groove encircling said peg in spaced relationship with said head portion;

c) an inclined bore, for receiving an end of the string, said bore having an entry opening in said groove and extending through said peg to an exit opening spaced from a center of said groove; and d) a notch extending transversely to and communicating with said groove adjacent said exit opening.

2. The peg of claim 1 in which said bore extends through said axis.

3. The peg of claim 2 in which said exit opening is aligned with said notch.

4. The peg of claim 3 in which said notch extends from said groove to said head portion.

5. The peg of claim 1 in which said exit opening is aligned with said notch.

6. The peg of claim 5 in which said notch extends from said groove to said head portion.

7. The peg of claim 1 in which said notch extends from said groove to said head portion.

8. A peg for adjustably securing a string to a stringed musical instrument, comprising:

a) a peg having an axis and a head portion;

b) a groove encircling said peg in spaced relationship with said head portion; and c) an inclined bore, for receiving an end of the string, said bore having an entry opening in said groove and extending through said peg to an exit opening spaced from a center of said groove.

9. The peg of claim 8 in which said bore extends through said axis.

* * * * *